US007527093B2

(12) United States Patent
Mosing et al.

(10) Patent No.: US 7,527,093 B2
(45) Date of Patent: May 5, 2009

(54) SELF-TIGHTENING SAFETY TUBULAR CLAMP

(75) Inventors: Donald E. Mosing, Lafayette, LA (US); Jeremy R. Angelle, Lafayette, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 87 days.

(21) Appl. No.: 11/532,203

(22) Filed: Sep. 15, 2006

(65) Prior Publication Data

US 2008/0066925 A1 Mar. 20, 2008

(51) Int. Cl.
*E21B 19/10* (2006.01)

(52) U.S. Cl. ..... 166/75.14; 166/77.51; 175/423

(58) Field of Classification Search ..... 166/75.14, 166/77.51, 382; 175/423; 188/67; 464/166
See application file for complete search history.

(56) References Cited

U.S. PATENT DOCUMENTS 1,119,446 A * 12/1914 Noftz ..... 464/166
1,366,571 A * 1/1921 Larsen ..... 464/166
2,896,292 A * 7/1959 Kinzbach ..... 188/67
3,025,582 A * 3/1962 Taylor ..... 188/67
4,715,456 A * 12/1987 Poe et al. ..... 175/423
6,394,201 B1 * 5/2002 Feigel et al. ..... 175/423
6,688,394 B1 * 2/2004 Ayling ..... 166/380
6,915,868 B1 * 7/2005 Mosing et al. ..... 175/423

OTHER PUBLICATIONS

Blohm and Voss Oil Tools Division Catalog—Safety Clamp; 2 pages.
Varco BJ Catalog—Multipurpose Safety Clamp; 3 pages.

* cited by examiner

*Primary Examiner*—David J Bagnell
*Assistant Examiner*—David Andrews
(74) *Attorney, Agent, or Firm*—Patrick K. Steele; Streets & Steele

(57) ABSTRACT

A self-tightening safety tubular clamp for suspending a casing string or other tubular member within a well. In one embodiment, a base has an opening for receiving the casing string. A first gripping member and an opposing second gripping member are each adapted to frictionally engage the casing string. First and second pivot arms include parallel linkages for supporting the gripping members. Each parallel linkage is pivotally secured to the base at one pivot pair, and pivotally secured to one of the gripping members at an upper pivot pair. Frictional contact with the gripping members allows the weight of the casing string to move the pivot arms downward. As the pivot arms move downward, the gripping members move downward and inward into engagement with the casing string. The parallel linkages ensure that gripping surfaces of the gripping members remains vertical, in alignment.

2 Claims, 6 Drawing Sheets

SELF-TIGHTENING SAFETY TUBULAR CLAMP

BACKGROUND OF THE INVENTION

1. Field of the Invention

The present invention relates to the drilling and completion of subterranean wells. The present invention relates to a clamp for gripping and suspending a tubular string in a borehole.

2. Description of the Related Art

A spider is an apparatus used for gripping and supporting long strings of pipe in a borehole, such as casing strings. A spider is generally mounted in the floor of drilling rig, and has a generally circumferential arrangement of slips that grip and hold the casing tighter as the weight of the casing is transferred to the slips. The spider is operable to disengage from and release the casing as the casing is lifted relative to the spider. An elevator attached to a hoist may be used to raise and lower the casing, and the elevator cooperates with the spider.

A spider typically includes a tapered bowl and a plurality of arcuate wedge-shaped slips held in a generally circumferential arrangement within a tapered bowl. The slips are normally moved to ride along the tapered surface of the spider bowl. The slips are adapted for being engaged and disengaged with the casing while maintaining contact with the tapered bowl. When the slips are raised, they move up and radially outward to increase the size of the opening in which the casing is received. Conversely, when the slips are lowered, the slips move down and radially inward to engage and support the casing. Frictional engagement between the casing and the slips draws the slips downward and inward along the tapered bowl and into tighter gripping engagement with the casing.

Spiders are generally adapted for supporting long, casing strings that may weigh in excess of 400,000 pounds (181,500 kg). To support the weight, spiders are generally made to be quite massive, with as many as 12 cooperating slips. The operation of spiders can therefore be time consuming. Spiders rely on self-tightening; that is, the weight of the casing string pulls the slips downwardly and inwardly along the spider bowl to bear firm against the casing. Insufficient engagement may result if the casing string is short and the casing string is too light too forcibly set the slips.

What is needed is an improved device for supporting relatively light tubular strings in a borehole. The improved device may allow tubular strings to be more quickly and easily assembled or disassembled, particularly when handling lighter tubular strings that do not require the load-bearing capacity of a conventional spider.

SUMMARY OF THE PRESENT INVENTION

The present invention provides a clamp for supporting a string of tubulars in a borehole, and the present invention provides a method of supporting a string of tubulars in a borehole. The present invention is specifically applicable to the support of a tubular string that is generally light in weight compared to strings that require more robust supports, such as a spider. In one embodiment, a pair of opposed articulating pivot arms, each having at least one parallelogram link for supporting and positioning a pipe gripping member. The articulating pivot arms cooperate to position gripping members for engaging and supporting the tubular.

DETAILED DESCRIPTION OF THE PRESENT INVENTION

The present invention provides a tubular clamp and a method of supporting a tubular string, such as a casing string, within a borehole. The tubular clamp of the present invention allows casing segments to be more quickly made up into or broken out of a tubular string, particularly when assembling (or disassembling) generally light-weight strings. Accordingly, the tubular clamp may be better suited than a conventional spider for the initial stages of making up a tubular string, or during the latter stages of breaking out and laying down a tubular string, when relatively fewer segments are suspended in the borehole. The tubular clamp may be particularly well adapted for use with casing strings under about 60,000 pounds (27,220 kg).

Figure 1:
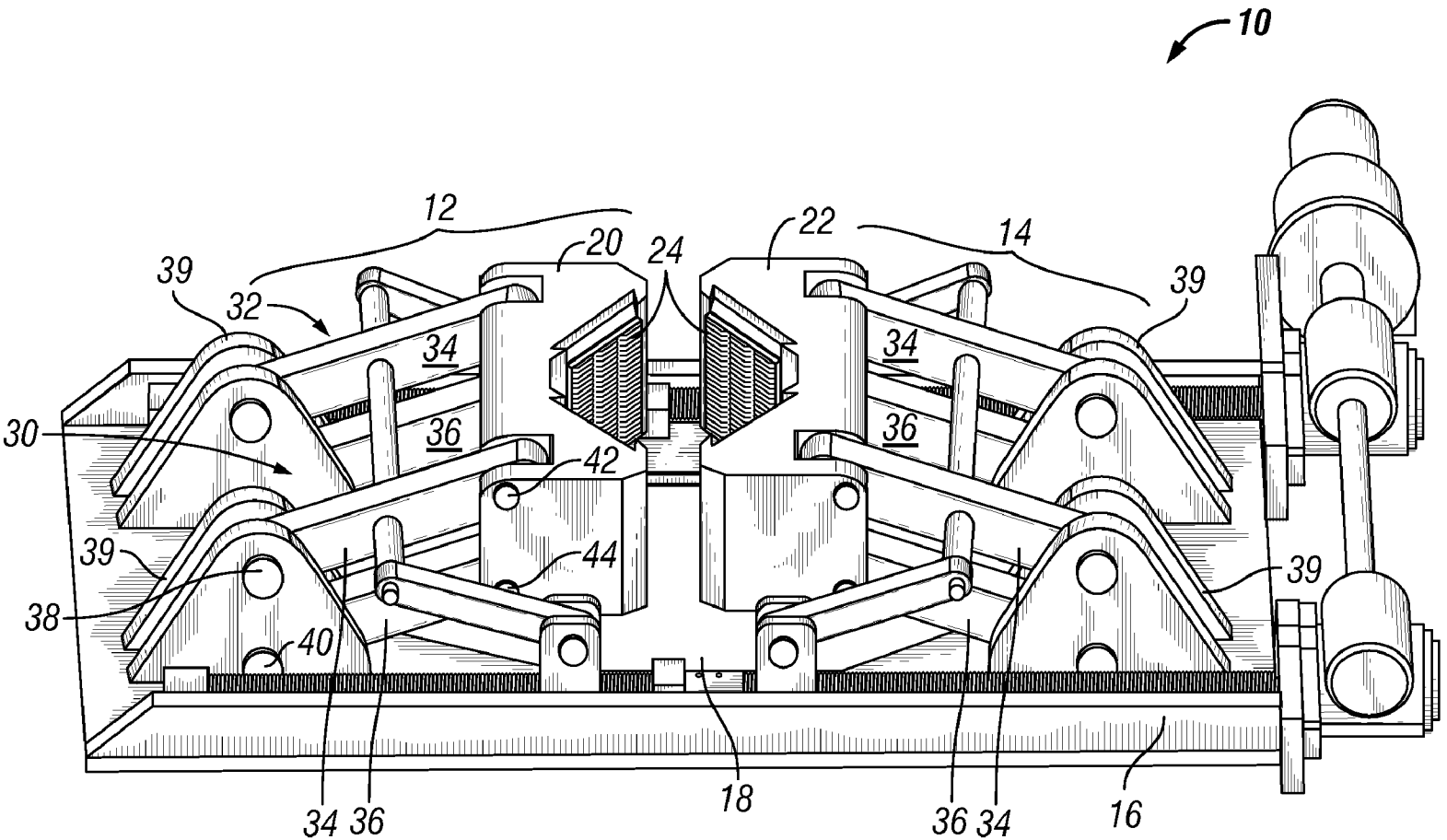
FIG. 1 is a perspective view of one embodiment of a tubular clamp of present invention.

FIG. 1 is a perspective view of one embodiment of a tubular clamp 10 of the present invention having a first articulating pivot arm 12 and an opposed second articulating pivot arm 14. The first pivot arm 12 and the second pivot arm 14 are pivotally supported on a base 16 at pin supports 39. The first and second pivot arms 12, 14 pivotally position and support gripping members 20, 22, respectively. One or more inserts 24 may be received on gripping members 20, 22 for frictionally engaging a tubular segment.

The base 16 includes an opening 18 for receiving a tubular segment. The base 16 may be supported by a spider or other structure with its opening 18 aligned with and positioned above a borehole. The base 16 comprises pin supports 39 for pivotally positioning and supporting pivot arms 12, 14. The tubular may be supported with the tubular clamp 10 by receiving the tubular within the opening 18 and by engaging the tubular with opposed gripping members 20, 22.

In the embodiment shown in FIG. 1, the first pivot arm 12 includes a first parallel linkage 30 and a second parallel linkage 32. Each parallel linkage 30, 32 includes four links: a fixed link, which is at least a portion of pin support 39, a superior link 34 pivotally coupled to pin support 39 at pin 38, an inferior link 36 pivotally coupled to pin support 39 nearer to base 16 at pivot 40, and a gripping member 20. The pair of pivots 38 and 40 is collectively referred to as the lower pivot pair. The superior link 34 and the inferior link 36 are each pivotally coupled to the first gripping member 20 at pivots 42 and 44, respectively. The pair of pivots 42 and 44 is collectively referred as the upper pivot pair. The pivots 38, 40, 42, 44 may include pins, sockets, links, hinges, elbows or other structures known in the art for pivotally coupling two links.

When positioned to support a tubular within a the borehole, the tubular clamp 10 is generally oriented so that the upper pivot pair 42, 44 is at a higher average elevation than the lower pivot pair 38, 40. Thus, clockwise rotation of the left pivot arm 12 shown in FIG. 1 causes the first gripping member 20 to move downwardly and radially inwardly relative to a tubular (not shown in FIG. 1) received through the opening 18 in the base 16. Generally symmetric features of the opposing second pivot arm 14, and counterclockwise rotation of the second pivot arm 14, causes the second gripping member 22 to also move downwardly and radially inwardly relative to a tubular (not shown in FIG. 1) received through the opening 18 in the base 16. Frictional contact between the inserts 24 and the tubular (not shown in FIG. 1) transfers the weight of the tubular to gripping members 20, 22 urging both downwardly, more forcibly engaging the gripping members 20, 22 with the tubular. Thus, the tubular clamp 10 is "self-tightening." The radially inwardly components of the compressive loads in superior links 34 and inferior links 36 substantially increase as the load of the tubular increases and the angle of approach of these links to the tubular increases, thereby increasing the radially inwardly directed engaging force of pipe gripping members 20, 22 against the gripped tubular.

Figure 2:
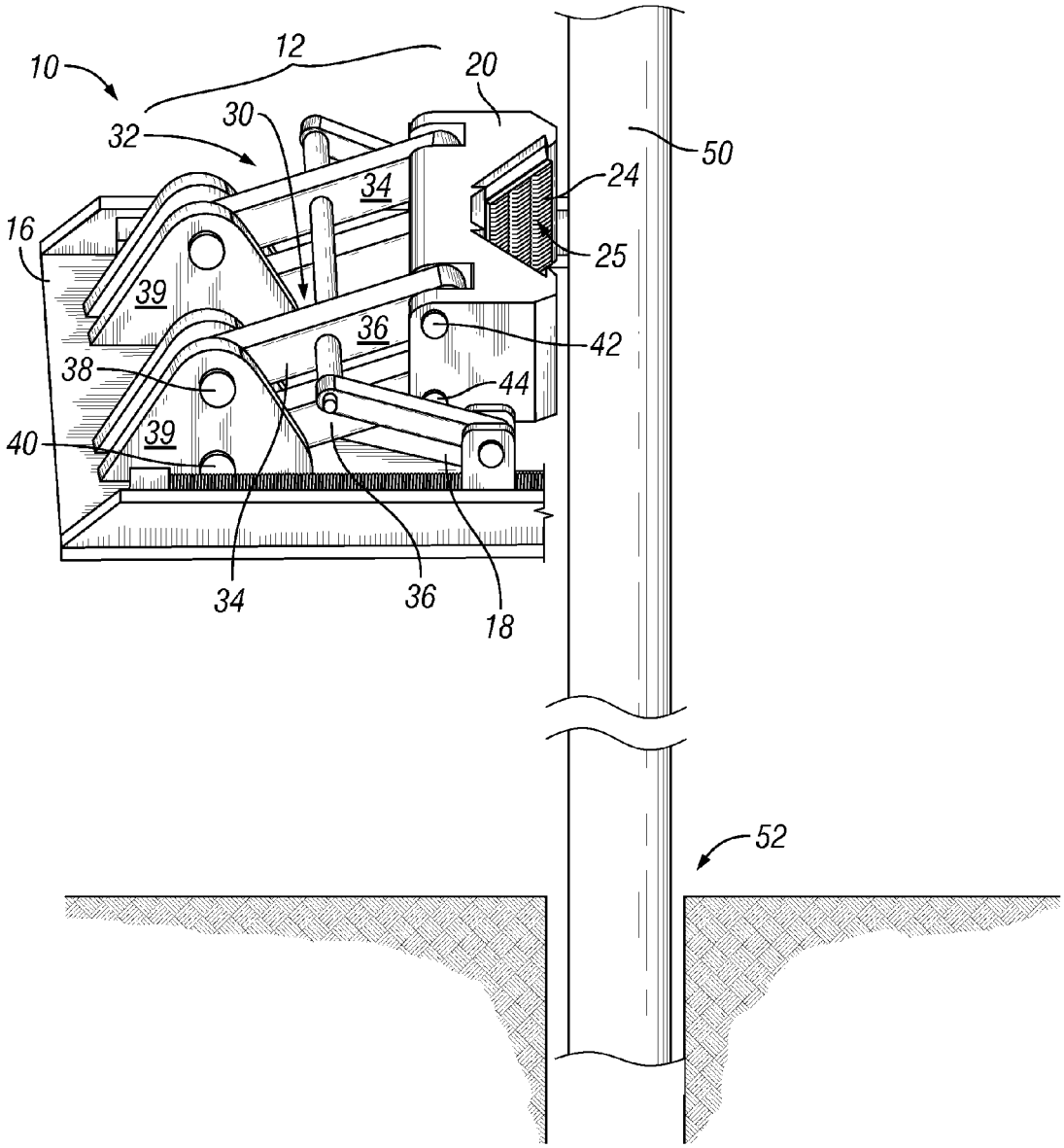
FIG. 2 is a perspective isolation view of one side of the embodiment of a tubular clamp shown in FIG. 1, with an articulating pivot arm supporting a gripping member adjacent to a tubular supported within a borehole.

In the embodiment shown in FIG. 1, the parallel linkage maintains the gripping faces of the gripping members 20, 22 in a generally vertical orientation with respect to the tubular throughout the critical range of movement of the pivot arm. FIG. 2 is a perspective isolation view of the left pivot arm 12 of the tubular clamp 10 shown in FIG. 1, with the gripping member 20 positioned near a tubular 50 now shown received through opening 18 of the base 16 and extending downwardly into borehole 52. The first parallel linkage 30 the second parallel linkage 32 are in their disengaged position supporting gripping member 20 a distance from the tubular 50. In the embodiment shown, the superior links 34 and inferior links 36 are shown to be generally parallel. However, a "parallel linkage," as that term is used herein, does not necessarily require the links themselves to be linear or truly parallel, and other embodiments of the tubular clamp having a substantially parallel linkage comprise one or more non-linear links. Generally, a line segment between pivots 38, 42 on each superior link 34 remains substantially parallel to a line segment between the pivots 40, 44 of each adjacent inferior link 36, and the two line segments are substantially equal in length. Moreover, the separation of pivot 38 and pivot 40 of each lower pivot pair supported by a pin support 39 is substantially equal to the separation of pivot 42 and pivot 44 of each upper pivot pair at the gripping member 20. Pivots 38, 42, 44, 36 together define the four corners of a parallelogram linkage having variable angles. Clockwise rotation of the parallel linkages 30 and 32 results in relative counter-rotation of gripping member 20 to maintain gripping faces 25 of the inserts 24 generally parallel relative to the tubular 50 as the pivot arm 12 rotates. This generally constant vertical orientation of gripping faces 25 allows the safety clamp of the present invention to accommodate a range of tubular diameters.

Figure 3:
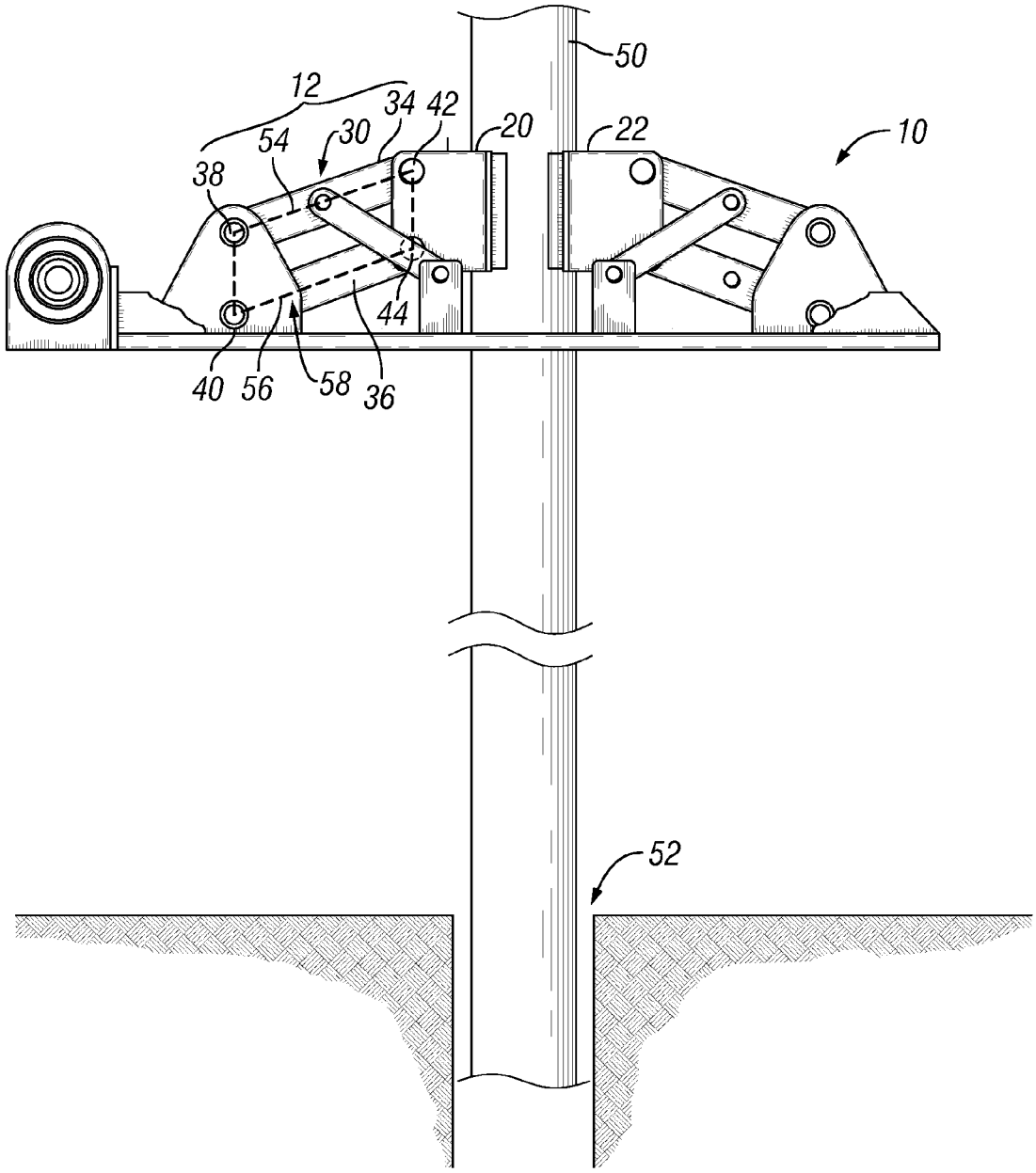
FIG. 3 is a side elevation view of one embodiment of the tubular clamp of the present invention, with opposed gripping members in gripping engagement with a tubular.

FIG. 3 is a side elevation view of the tubular clamp 10 of the present invention better illustrating the kinematics of a parallel linkage 30. The tubular clamp 10 is shown in its engaged position with gripping members 20, 22 engaging opposite sides of the tubular 50. A reference parallelogram 58 (indicated by dashed lines) is superimposed on the parallel linkage 30 and connects pivots 38, 42, 44, and 40. As pivot arm 12 rotates, segments 54, 56 of the parallelogram 58 will remain substantially parallel one relative to the other. This relationship between the pivots of the parallel linkage is true even in embodiments with links that are not truly linear or not perfectly parallel.

Figure 4:
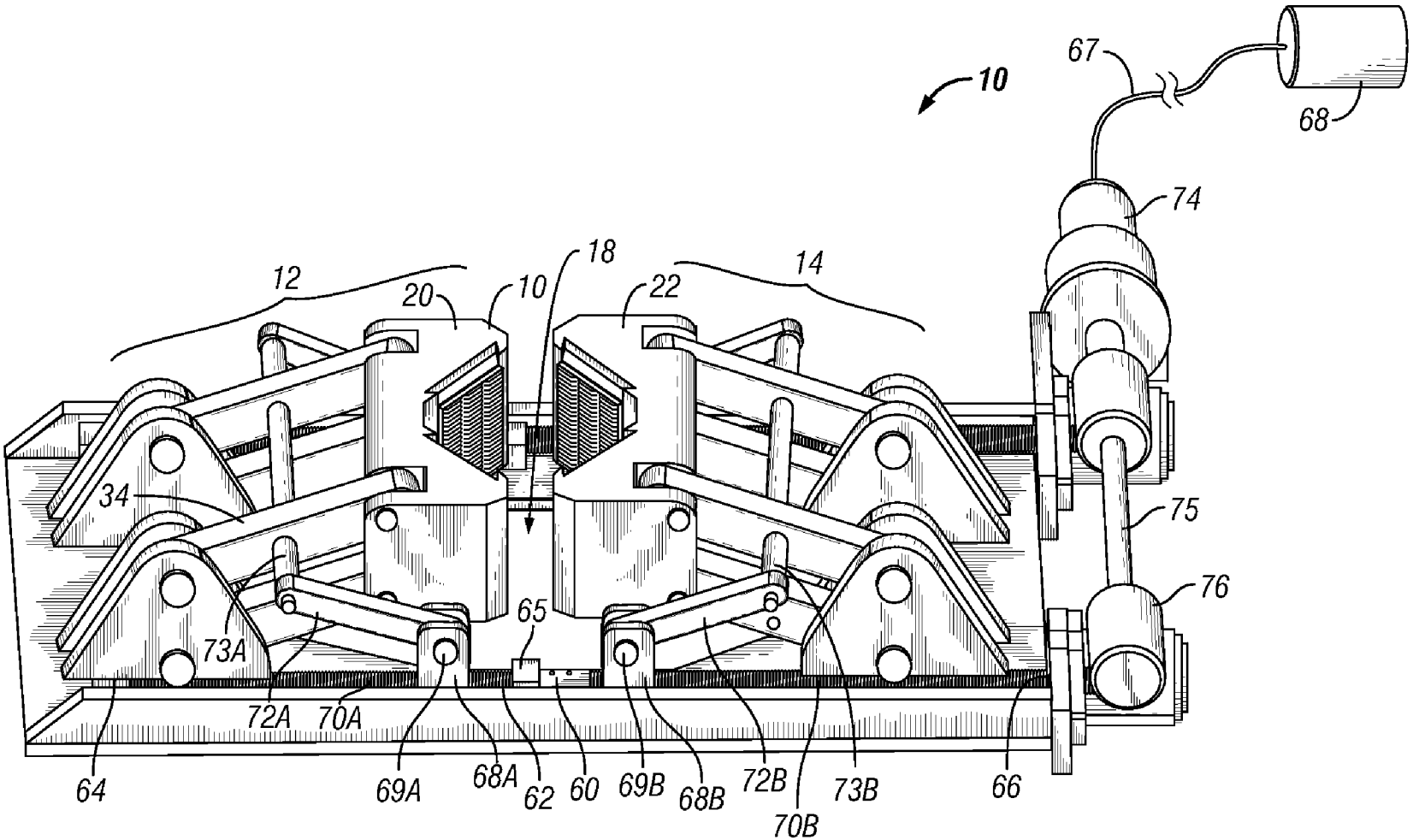
FIG. 4 is perspective view of one embodiment of the tubular clamp of the present invention having a powered engagement assembly.

Embodiments of a tubular clamp of the present invention may include an actuator operatively coupled to the pivot arms to selectively rotate the pivot arms and position the gripping members. FIG. 4 is perspective view of one embodiment of the tubular clamp 10 having a powered engagement assembly 60 for articulating the pivot arms 12, 14. A threaded rod 62 of the assembly is rotatably supported at supports 64, 65 and 66. The threaded rod need not be threaded along its entire length. The threaded rod 62 of FIG. 4 comprises a rod having two separate threaded sections 70A and 70B, each having opposite thread directions one relative to the other. For example, if the threaded portion 70A has "right-handed" threads, then the threaded portion 70B has "left-handed" threads. Thus, pivot arms 12, 14 may be synchronously rotated and positioned by rotating threaded rod 62 in a first direction, or synchronously lowered by rotating the threaded rod 62 in the opposite direction. A first threaded guide member 68A threadably receives first threaded portion 70A of threaded rod 62. A first connecting link 72A is pivotally secured near its first end to first threaded guide member 68A at pivot 69A and pivotally secured at its second end to superior link 34 of the first pivot arm 12 at pivot 73A. A second connecting link 72B is similarly secured to second threaded guide member 68B at pivots 69B and 73B. The pivots 69A, 69B, 73A, and 73B may include a pin, socket, rod, hinge, elbow or another device for pivotally securing two links. A motor 74 is operatively coupled to the threaded rod 62 via a shaft 75 and a drive gear 76 for rotating the threaded rod 62 upon actuation of motor 74. The motor 74 may be pneumatically, hydraulically, electrically or manually powered using power source 68 and an electrical or fluid conduit 67. Rotating the threaded rod 62 with the motor 74 axially advances first threaded guide member 68A along the first threaded section 70A of threaded rod 62 to rotate and position pivot arm 12. Simultaneously, rotation of threaded rod 62 advances the second threaded guide member 68B along the second threaded section 70B of threaded rod 62 to rotate and position pivot arm 14 to cooperate with opposing pivot arm 12 to engage or release a tubular (not shown in FIG. 4) received through the opening 18 and between opposed gripping members 20 and 22.

The motor 74 need only provide sufficient power to move gripping members 20 and 22 into firm contact with a tubular (not shown in FIG. 4). Once in frictional contact with the tubular, the weight of the tubular frictionally drives gripping members 20 and 22 downwardly and inwardly into full supporting engagement with the tubular.

Other embodiments of a powered engagement assembly may be devised according to the invention for rotating pivot arms 12, 14 of tubular clamp 10. For example, one embodiment may include a motorized rack and pinion assembly mounted on the base 16 and coupled with pivot arms 12, 14 for selectively rotating pivot arms 12, 14. Another embodiment may include hydraulic or pneumatic cylinders instead of the connecting links 72, 82 of FIG. 4. For example, a cylinder may be pivotally coupled to and supported on the base and pivotally coupled to a pivot arm to selectively rotate the pivot arm about its lower pivot pair.

Figure 5:
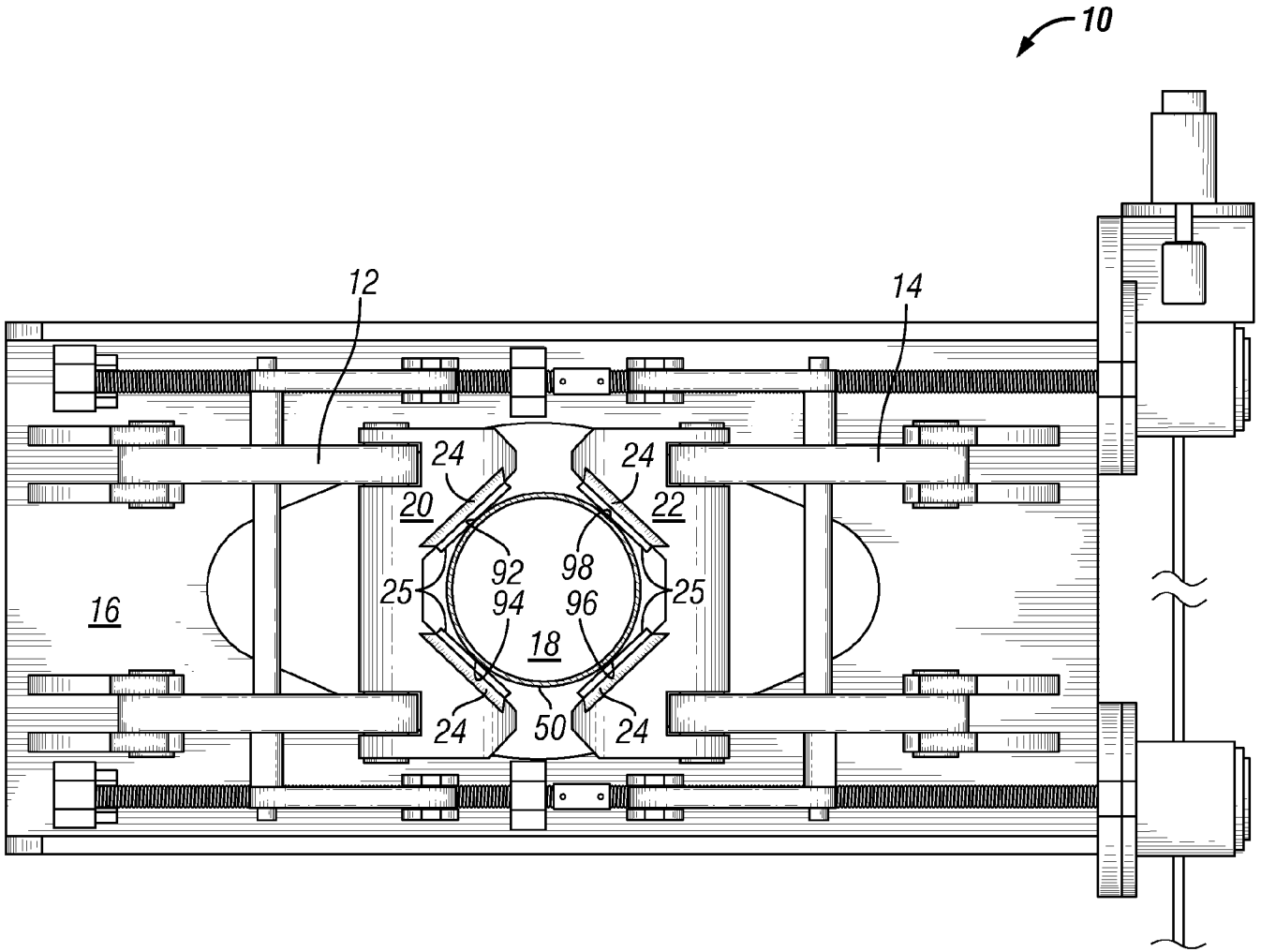
FIG. 5 show a top-view of one embodiment of the tubular clamp of the present invention with inserts received in the gripping member for contacting the tubular.

FIG. 5 shows an overhead cross-sectional view of one embodiment of the tubular clamp 10 of the present invention. The adjacent contact faces 25 of inserts 24 in opposed gripping members 20, 22 form an angle, one relative to the other, of less than 180 degrees and, more preferably, between 70 and 130 degrees. A segment of tubular 50 is received and positioned within the opening 18 in the base 16 between the first gripping member 12 and the second gripping member 14. The gripping members 20, 22 are shown in FIG. 5 to be positioned by pivot arms 12, 14 to engage tubular 50. Due to the flat, angled orientation of each adjacent pair of inserts 24, the tubular clamp 10 accommodates a range of tubular diameters of the tubular 50 determined by the size of the gripping members 20, 22 and the angle formed between the inserts 24, one relative to the adjacent insert. The diameter of the tubular 50 shown in FIG. 5 results in contact with tubular 50 at vertical lines 92, 94, 96 and 98 in the middle of inserts 24. This means that the diameter of tubular 50 is approximately in the middle of the suitable range of tubular diameters for this clamp 10. Other tubular diameters will result in contact at adjacent vertical lines along inserts 24 in one direction for larger diameters, in the other for smaller diameters. The angled orientation of the inserts 24 of gripping members 20, 22 causes each gripping member 20, 22 to contact and engage, through inserts 24, the gripped tubular 50 at two locations. For example, as shown in FIG. 5, gripping member 20 contacts the tubular 50 along vertical lines 92, 94, and gripping member 22 contacts the tubular 50 along vertical lines 96, 98.

Figure 6:
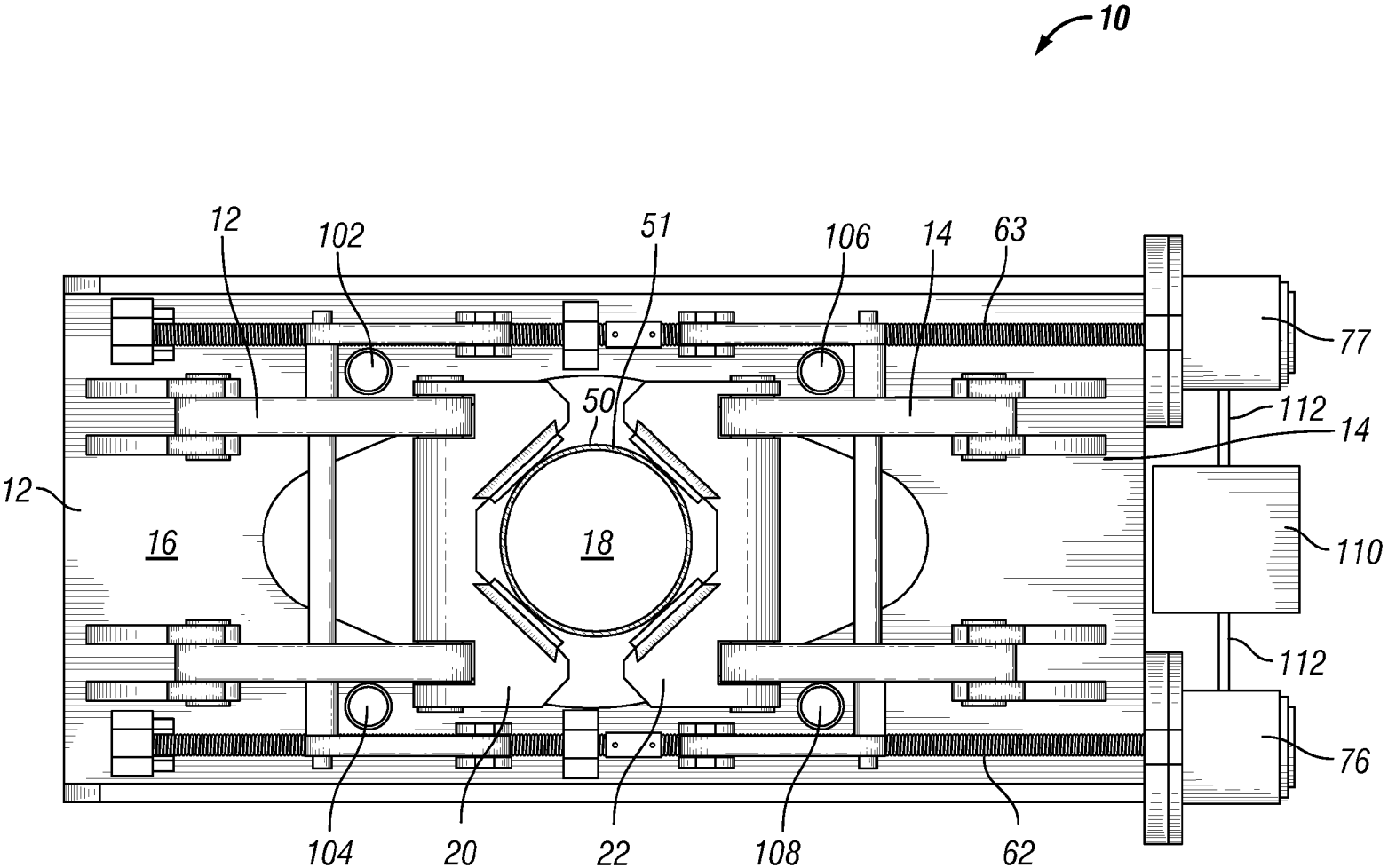
FIG. 6 illustrates an embodiment of a tubular clamp of the present invention having an alternative motor position and torque-resisting stop members.

FIG. 6 illustrates some optional features and configurations of a tubular clamp 10, wherein reference numerals refer to like elements from FIGS. 1-5. Undesired lateral movement or twisting of pivot arms 12, 14 may result from the tubular 50 being torqued about its vertical axis, such as when a power tong (not shown) engages and torques to an adjacent tubular segment being threadably coupled to the exposed end 51 of the tubular 50 suspended in the tubular clamp 10. Such torque transfer may place a large amount of unwanted stress on the parallelogram linkages (see element 30 in FIG. 3) and pivots (see element 38, 40, 42 and 44 of FIG. 2) of the pivot arms 12, 14. One option is to make the parallelogram linkages and pivots robust and strong enough to withstand repeated lateral and torsional loading. This remedy will result in substantially increased weight and cost.

Another alternative, as shown in FIG. 6, is to provide one or more to torque-resistant stops 102, 104, 106 and 108 to restrict lateral deflection of pivot arms 12, 14 resulting from lateral or torsional loading due to torquing of tubular 50. In the embodiment shown in FIG. 6, stops 102, 104, 106, 108 are secured to and protrude upwardly from base 16 in close proximity to pivot arms 12, 14 when in the pivot arms are rotated to their engaged positions to limit undesired lateral deflection of the pivot arms 12, 14. The stops 102, 104, 106 and 108 may be vertical posts welded or otherwise secured to the base 16. In some embodiments, the height of stops 102, 104, 106, 108 may be minimized by optionally selecting the height to be no greater than the vertical distance of the inferior links (see element 36 in FIGS. 1 and 2) (supporting pivot arms 12, 14) from the base 16 when the tubular clamp 10 is engaged with a tubular 50 of the largest diameter to be suspended by the safety clamp. If the tubular 50 is torqued clockwise due to threadable engagement of an adjacent tubular segments, the tubular 50 transfers at least some of that clockwise torque to the pivot arms 12 and 14 through gripping members 20 and 22, respectively. Lateral deflection of pivot arm 12 will be restricted by post 102, and lateral deflection of pivot arm 14 will be restricted by post 108. Similarly, if the tubular string 90 is torqued counter-clockwise, the tubular string 90 transfers at least some of that counter-clockwise torque to the pivot arms 12 and 14 through gripping members 20 and 22. Lateral deflection of pivot arm 12 will be restricted by post 104, and lateral deflection of pivot arm 14 will be restricted by post 106.

Another feature of the embodiment of the tubular clamp 10 shown in FIG. 6 is the optional position of the motor 110. The motor 110 is positioned between the first drive gear 76 and second drive gear 77. A drive axle 112 simultaneously drives the first and second drive mechanisms 76, 77 to synchronously rotate threaded rods 62, 63. The first drive gear 76 transmits mechanical power from motor 110 to rotate threaded rod 62, and the second drive gear 77 transmits mechanical power from motor 110 to rotate threaded rod 63 which is generally parallel to and across base 16 from rod 62. Rotation of the threaded rod 62 rotates the pivot arms 12, 14 from one side, while generally synchronous rotation of threaded rod 63 rotates first and second pivot arms 12, 14 from the other side, to balance the applied rotational torque of the motor 110 transferred to the pivot arms 12, 14 by rotation of the threaded rods 62 and 63.

The tubular clamp embodiments in FIGS. 1-6 all include two cooperating, opposing pivot arms 12 and 14, each spaced 180 degrees one from the other and each supporting a corresponding gripping member 20 and 22, respectively. In other embodiments of the present invention, three or more radially-distributed pivot arms may be provided. For example, another embodiment may have three cooperating pivot arms angularly spaced at 120 degrees, or four pivot arms angularly spaced at 90 degrees, about opening 18 for receiving a tubular.

The actuator improves the ease and efficiency of rotating the pivot arms 12, 14 to position the gripping members 20, 22. Embodiments with threaded actuator rods each having two oppositely-threaded portions simplifies the use of the tubular clamp 10 by rotating both pivot arms synchronously. Such features significantly reduce time for make up of lighter weight tubular strings, such as near the earlier stages of assembling a tubular string and inserting it into the well. Such embodiments may be particularly useful with tubular strings under about 60,000 lbs, which do not typically require as great a load-bearing capacity as longer, heavier casing strings.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the below claims.

What is claimed is:

1. An apparatus for supporting a tubular in a borehole, comprising:

a base having an opening for receiving a tubular;

a first gripping member and a second gripping member, each adapted to frictionally engage the tubular;

a first pivot arm including at least one parallel linkage pivotally secured to the base at a lower pivot pair and pivotally secured to the first gripping member at an upper pivot pair positionable above the lower pivot pair;

a second pivot arm including at least one parallel linkage pivotally secured to the base at a lower pivot pair and pivotally secured to the second gripping member at an upper pivot pair positionable above the lower pivot pair; and an actuator comprising:

a threaded rod having a first threaded portion and a second threaded portion;

a first threaded guide member threadably coupled to the first threaded portion of the threaded rod;

a first connecting link pivotally secured to the first threaded guide member at a first end and pivotally secured to the first pivot arm at a second end;

a second threaded guide member threadably coupled to the second threaded portion of the threaded rod; and a second connecting link pivotally secured to the second threaded guide member at a first end and pivotally secured to the second pivot arm at a second end;

wherein the first and second threaded portions are reverse-threaded; and wherein rotation of the threaded rod positions the first and second gripping members.

2. An apparatus for supporting a tubular in a borehole comprising:

a base having an opening for receiving a tubular there through;

a first pivot arm comprising four links, including a fixed link, and rotatably coupled to the base at the fixed link to allow movement of the three remaining links in a plane generally perpendicular to the opening;

a first gripping member supported by the first pivot arm at a link opposite the fixed link; a second gripping member; and an actuator coupled to the first pivot arm to rotate the pivot arm between an engaged position and a disengaged position comprising:

a threaded rod rotationally supported on the base;

a first threaded guide member threadably coupled to the threaded rod; and a first connecting link pivotally secured to the first threaded guide member at a first end and pivotally secured to the first pivot arm at a second end;

wherein that rotation of the threaded rod raises or lowers the first pivot arm; and wherein the first gripping member and the second gripping member cooperate to support the tubular received within the opening.

* * * * *